United States Patent [19]

Funk et al.

[11] 4,075,465

[45] Feb. 21, 1978

[54] KEYBOARD OVERLAY

[75] Inventors: Buddy Keith Funk, Bountiful; Elton Earl Tetrick, Draper, both of Utah

[73] Assignee: Sperry Rand Corporation, New York, N.Y.

[21] Appl. No.: 687,836

[22] Filed: May 19, 1976

[51] Int. Cl.[2] ..... B41J 5/08; G06C 7/02

[52] U.S. Cl. ..... 235/145 R; 35/5; 197/98

[58] Field of Search ..... 235/145 R; 197/98; 35/5, 6

[56] References Cited

PUBLICATIONS

"Plastic Keyboard Translator" by C. C. Kling, IBM Tech. Disc. Bulletin, vol. 4, No. 12, May 1962.

"Changeable Array Keyboard" by Cooper and Harrison, IBM Tech. Dicl. Bull., vol. 11, No. 5, Oct. 1968.

"Keybaord Overlay" by R. G. Cross, IBM Tech. Discl. Bull., vol. 15, No. 1, June 1972.

*Primary Examiner*—Stephen J. Tomsky

*Attorney, Agent, or Firm*—John R. Flanagan; Marshall M. Truex

[57] ABSTRACT

An exchangeable overlay for changing the character representations associated with the keys of a keyboard. The overlay is disposed on the keyboard and has openings to receive each key thereof with the inner portion of each opening above an associated key sloped to form a character bearing surface of easy visibility.

6 Claims, 3 Drawing Figures

KEYBOARD OVERLAY

BACKGROUND OF THE INVENTION

It is often required that the symbols associated with the keys of a keyboard be changed. This is particularly true where the keyboard is used as an input terminal to provide data and/or function control inputs to a data processor. An example of this would be a computer terminal used in the education field to train students in different foreign languages.

Recently there have been innovations in output display technology. The printing mechanism on typewriters allows changes from one character font or language to another by changing the print "ball" or "wheel". On printers or video displays using dot matrix character generation, new characters can be defined by altering what is stored in the section of memory referred to as character generator memory. This section of memory can and historically has been permanent. Recently there have been devices that allow the character generator memory to be altered or modified, either by action at the device or by a series of commands transmitted through a communication interface from a remote location. There is a need to alter the character representations on the keyboard keys to correspond with the changes in the display characters.

Prior methods for changing the symbols or character representations of each key of a keyboard required that each keycap be changed. This entailed considerable time, for example, ten to fifteen minutes for the typical keyboard. In addition special tools in the hands of a reasonably skilled mechanic are also required.

The present invention contemplates a device wherein the symbols or character representations associated with the keys of a keyboard may be changed in a very short time, e.g., seconds and which permits the change to be done by anyone.

More specifically the present invention contemplates an overlay having openings for each of the keys of the keyboard. The overlay is mounted on the keyboard. Each of the openings has a sloped portion above its adjacent key which provides a highly visible surface bearing the symbols or character representations associated with each key. The overlay is exchangeable with other overlays bearing different symbols as required by each program.

OBJECTS OF THE INVENTION

It is an object of the present invention to provide a device to change the symbols associated with the keys of a keyboard.

Another object of the present invention is to provide an exchangeable overlay for quickly changing the character representations associated with the keys of a keyboard.

A further object of the present invention is to provide an exchangeable overlay for mounting on a keyboard which provides easily visible symbols associated with each of the keys of a keyboard.

Yet another object of the present invention is to provide an overlay for quickly changing the character representations of the keys of a keyboard without the need for special tooling or trained personnel.

Other objects and many of the attendant advantages of the present invention will become more apparent with the reading of the following description in conjunction with the accompanying drawings.

DESCRIPTION OF THE INVENTION

Figure 1:
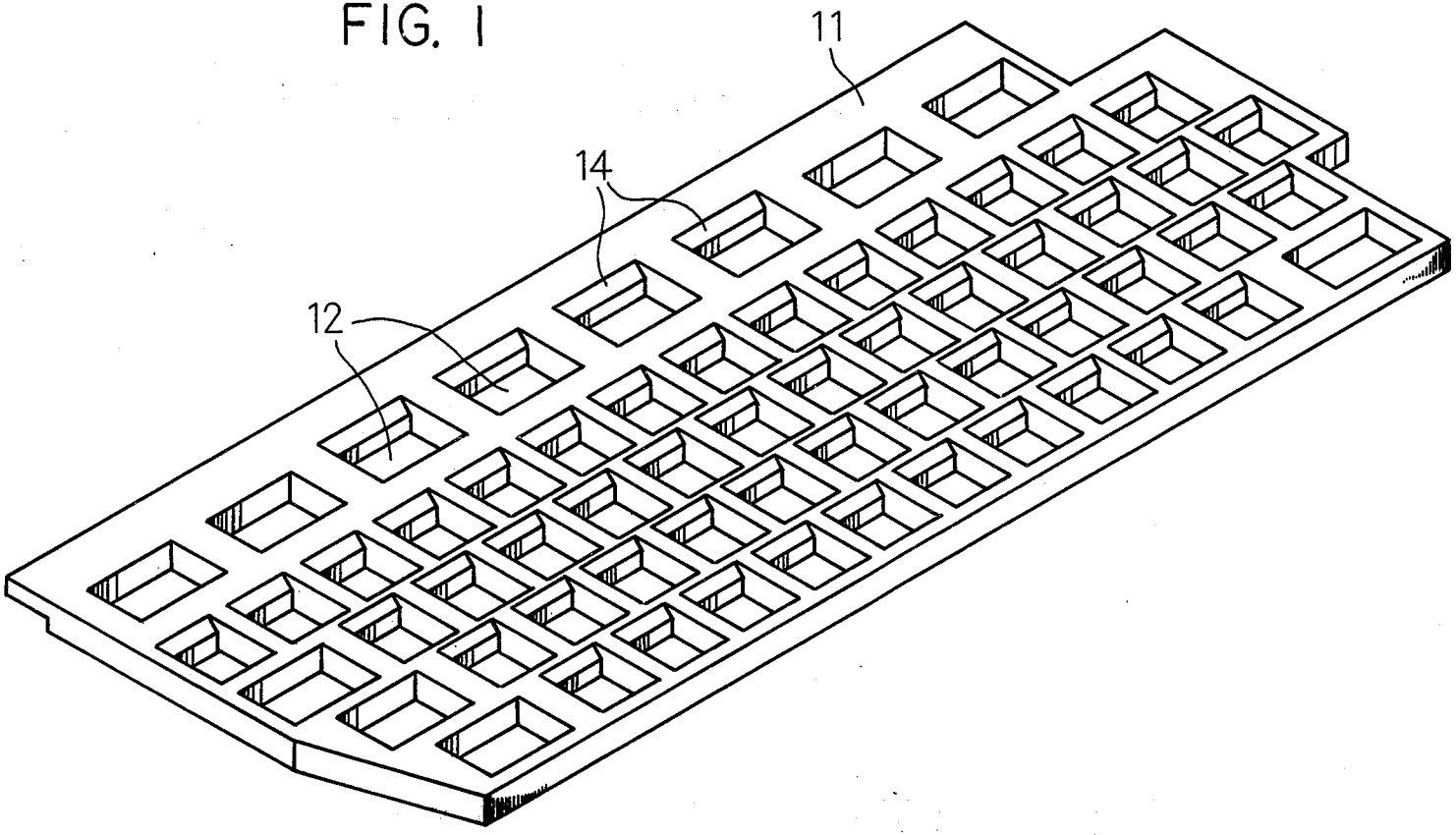
FIG. 1 is a top view of the keyboard overlay of the present invention.

Referring now to FIG. 1, there is shown an overlay 11 for use with a typical keyboard of the type used with a terminal for entering data and function commands into a data processing system.

Figure 3:
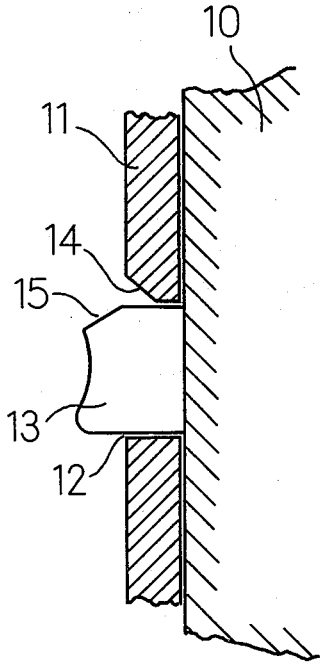
FIG. 3 is a partial side sectional view taken through line 3—3 of FIG. 2.

FIG. 3 shows a portion of the overlay 11 in place on a keyboard 10. The overlay has openings 12 for receiving each key 13 of the keyboard 10.

The tops of the keys of the keyboard 10 are blank, i.e., none has a symbol or character representation inasmuch as the overlay 11 carries the markings as shown on surfaces 14 of the overlay 11. Some of the keys 13 will not have a surface 14 associated therewith, and this is due to the fact that some keys of a keyboard provide inputs, e.g., functional which do not vary regardless of changes in the program such as backspace, tab, carriage return and shift keys. While not shown, the tops of such keys would have a symbol indicative of their functions.

The overlay 11 may be made of any suitable material such as polycarbonate, polystyrene, acrylic or acetate-butylate-styrene (ABS). Due to its fitting over the keys, the overlay 11 is secure on the keyboard 10. If desirable, it may also have end clips (not shown) to further provide a secure mount. The overlay 11 is easily exchangeable with other overlays which bear different indicia dependent on the character generator in use. Thus, each time a character generator is changed, the overlay 11 may be quickly exchanged for the appropriate different overlay.

Figure 2:
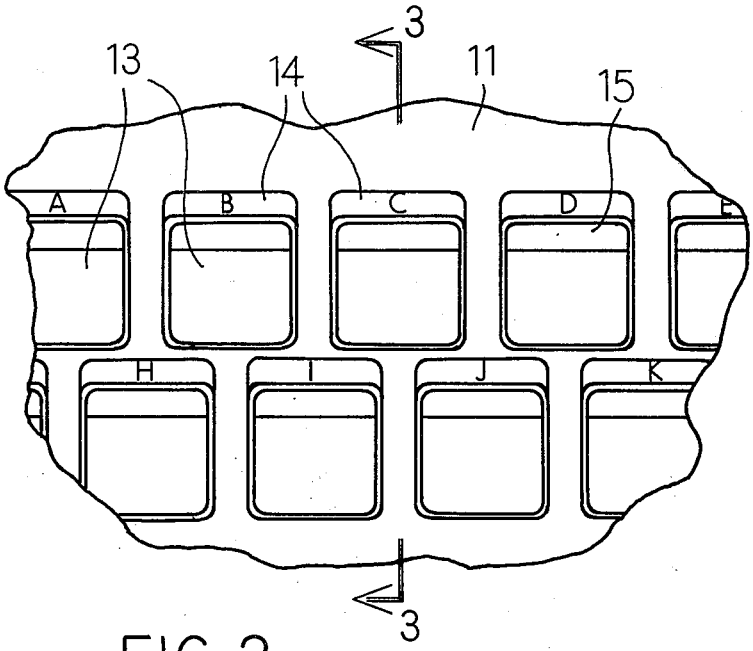
FIG. 2 is a broken away portion on a larger scale of a typical portion of FIG. 1 and also showing the associated keyboard.

FIGS. 2 and 3 show an enlarged portion of the arrangement of FIG. 1. The overlay 11 has openings 12 for receiving each of the keys 13. The keys 13 extend beyond the thickness of the overlay so that when the key is fully depressed, the level of the key top is still above the level of the overlay. Since the typical keyboard for which the overlay is used is electronic, only a slight push of a key is required. It should be pointed out, however, that the present invention will work where the keys operate in a mechanical fashion.

The portion of the inside surface of each of the openings 12 in the overlay 11 which is adjacent the upper portion of a key 13 is sloped to form a surface 14 on which a symbol or character representation (i.e., A, B, C, etc., as seen in FIG. 2) may be formed in any convenient manner such as printing or etching or the like. The surface 14 has a slope of approximately 50 degrees, measured with respect to the face of the overlay, and is easily visible to an operator in the normal operating position.

Each of the surfaces 14 has a different indicium thereon which may be alphanumeric or a function symbol.

In order to enhance even further the visibility of the character representation or symbol, the keys 13 of the keyboard 10 have their upper edge which is adjacent the surface 14 removed. This is shown by reference numeral 15.

Thus, the keyboard, which normally is raised at an angle facing the operator, permits the indicia to be easiy seen even when the keyboard is horizontal or when the operator is not looking down in direct alignment with the keyboard.

The overlay 11 is easily removed and replaced with another overlay bearing different indicia, e.g., when the terminal is to be used in a different application and the character generator memory is to be altered by some means.

Other modifications of the present invention are possible in the light of the above description, and no limitations should be placed on the invention other than those set forth in the claims which follow.

What is claimed is:

1. A structure for mounting on a keyboard containing a plurality of keys, comprising in combination:

an overlay disposable on the keyboard and having a plurality of inside surfaces defining openings for each of the keys of the keyboard; and a portion of at least some of said inside surfaces, which define said openings, being sloped and displaying a symbol associated with respective ones of said keys.

2. A structure according to claim 1, wherein said portions of the respective inside surfaces each has a symbol formed thereon and will be disposed adjacent an upper side of its respective one of the keys when said overlay is disposed on said keyboard.

3. A structure according to claim 1, wherein said each inside surface portion is slanted away from its respective key to provide easy visibility of the symbol on said portion.

4. In combination:

a keyboard comprising a plurality of keys;

an exchangeable overlay having a like plurality of inside surfaces defining openings to receive said keys of said keyboard; and a portion of at least some of said inside surfaces, which define said openings, being sloped and displaying a symbol for association with respective ones of said keys.

5. The combination of claim 4, wherein said portions of said respective inside surfaces each has a symbol formed thereon and is disposed adjacent an upper side of its respective one of said keys.

6. The combination of claim 4, wherein said each inside surface portion slopes away from its respective key to provide easy visibility of said symbol on said portion.

* * * * *